United States Patent [19]

Pardee

[11] 4,437,545

[45] Mar. 20, 1984

[54] STEP LADDER

[75] Inventor: Ernest Pardee, Newport, N.Y.

[73] Assignee: Charles Mankouski, Middleville, N.Y.

[21] Appl. No.: 325,983

[22] Filed: Nov. 30, 1981

[51] Int. Cl.[3] ..... E06C 7/44

[52] U.S. Cl. ..... 182/171; 182/200

[58] Field of Search ..... 182/165, 169, 170, 171, 182/200

[56] References Cited

U.S. PATENT DOCUMENTS

| | | | |
|---|---|---|---|
| 203,561 | 5/1878 | Sherwood | 182/200 |
| 603,579 | 5/1898 | Richardson | 182/169 |
| 1,258,332 | 3/1918 | Hampton | 182/171 |
| 1,424,934 | 8/1922 | Paterson | 182/169 |
| 1,442,694 | 1/1923 | Martin | 182/169 |
| 1,511,580 | 10/1924 | Prince | 182/165 |
| 2,639,853 | 5/1953 | Pierce | 228/21 |
| 2,971,602 | 2/1961 | West | 182/200 |
| 3,978,944 | 9/1976 | Hickman | 182/162 |

FOREIGN PATENT DOCUMENTS

| | | | |
|---|---|---|---|
| 115514 | 12/1929 | Austria | 182/200 |
| 192761 | 11/1957 | Austria | 182/200 |
| 616025 | 1/1961 | Italy | 182/169 |

*Primary Examiner*—Reinaldo P. Machado
*Attorney, Agent, or Firm*—John Maier, III

[57] ABSTRACT

A step ladder for use on an uneven surface including an arcuate leveling member adapted to hold the step ladder straight on an uneven surface with means for securing the leveling member in any selected position.

2 Claims, 5 Drawing Figures

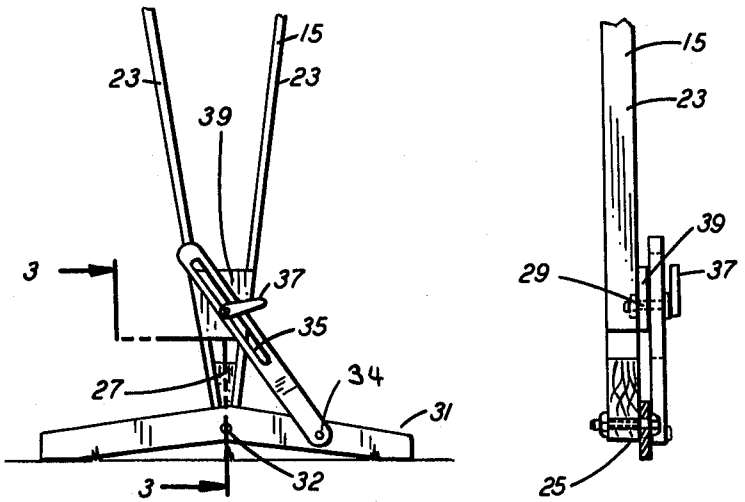
FIG. 3
FIG. 2
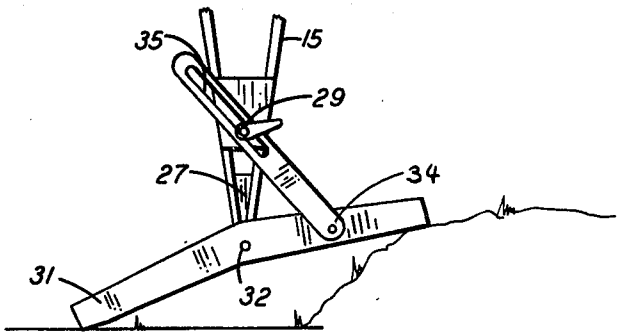
FIG. 4
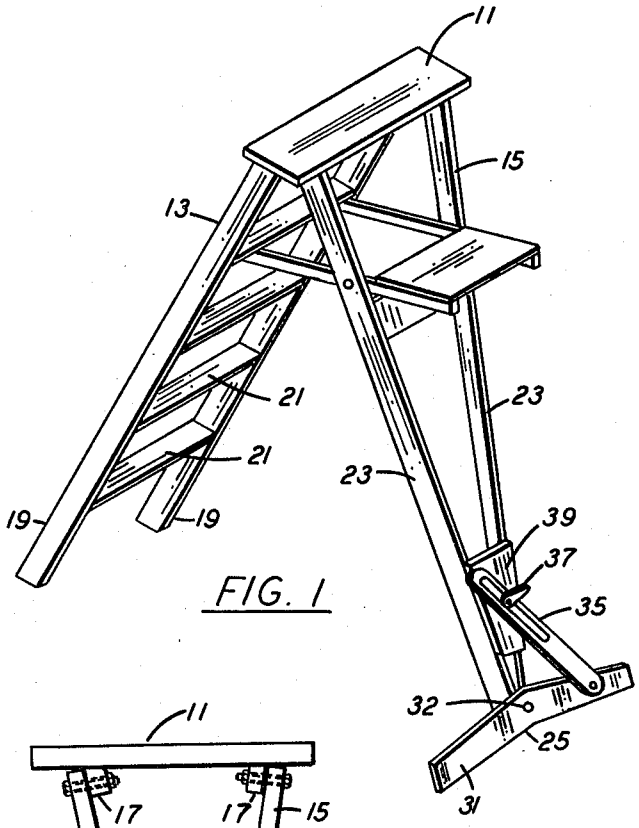
FIG. 1
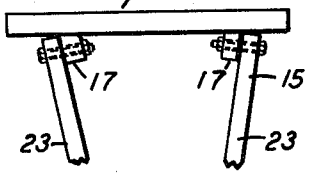
FIG. 5

STEP LADDER

FIELD OF THE INVENTION

This invention relates generally to step ladders for use on an uneven surface.

STATEMENTS OF THE PRIOR ART

Various types of ladders have been developed for use on uneven surfaces. One recent example is the Hickman Patent, U.S. Pat. No. 3,978,944, which uses individually folding separate struts on each side of a ladder which is supported primarily by two main members pivoted together. A feature of the Hickman Patent is its foldability. Another example is the West Patent, U.S. Pat. No. 2,971,602, which uses an arcuately-shaped leveling member but which is slidably mounted in an arcuately-shaped retaining ring. Still another example is the Pierce Patent, U.S. Pat. No. 2,639,853, which uses a pivotable member mounted on a cross bar between two side members of a step ladder. Still another example is the Martin Patent, U.S. Pat. No. 1,442,694, which mounts a massive leveling means on the step side of the ladder and uses a side mounted adjustment rod on the side of the ladder to fix the position of the leveling means. The Richardson Patent U.S. Pat. No. 603,579, uses a separate set of legs mounted on the step side of a step ladder which legs are pivotably mounted for adjustment and which eliminate the use of the lower end of the step side of the ladder itself. The Sherwood Patent, U.S. Pat. No. 203,561, teaches a double step ladder which can be extended into an extension ladder and which uses a pivotable leveling means with two adjustment rods which are unsecured and are merely placed in a loop affixed to the back of the next higher step.

The principal object of this invention is to provide a step ladder for use on uneven surfaces which provides easy construction, durability and elimination of massive parts.

Another object of this invention will in part be obvious and in part hereinafter pointed out.

The invention clearly consists of the features of construction, combination of elements and arrangements of parts which will be exemplifed in the construction hereinafter described in which the scope of application will be indicated in the following claims.

SUMMARY OF THE INVENTION

This invention resides in a step ladder for use on uneven ground with a top platform having a generally rectangular shape and having a step frame and a support frame each pivotably mounted near opposite edges and to the underneath surface of the top platform. The support frame includes two side members which come to an apex at their base with a V-shaped block rigidly mounted to create a solid end to the apex and a leveling bar which is arcuately shaped with the ends of the leveling bar extending below the apex of the support frame. The leveling bar is pivotably mounted at its center point on the end of the apex. An adjustment bar extends at an angle from a point midway between the center point of the leveling bar and one end and is pivotably mounted at that point to the leveling bar. The adjustment bar has a long slot on it and a screw means is rigidly mounted in the V-shaped block and extends into and slidably engages the slot. A bolt or nut means threadably engages the bolt means and is used to tighten down against the adjustment bar to hold the adjustment bar and therefore the leveling bar in whatever position is desired depending on the condition of the ground on which the step ladder is placed.

The novel features which are considered as characteristic of the invention are set forth with particularity in the appended claims.

The invention, itself, however, as to its construction and obvious advantages will be best understood from the following description of the specific embodiment when read with the accompanying drawings.

BRIEF DESCRIPTION OF THE DRAWINGS

In the accompanying drawings, like reference characters identify the same or like part.

FIG. 1 is a perspective view of the step ladder embodying the invention.

FIG. 2 is a fragmentary rear elevation of the lower portion of the step ladder.

FIG. 3 is a cross-sectional view along line 3—3 of FIG. 2.

FIG. 4 is a fragmentary rear elevation of the lower portion of the step ladder showing the leveling bar in an uneven ground situation.

FIG. 5 is a fragmentary rear elevation of the upper portion of the step ladder showing the top platform.

DESCRIPTION OF THE PREFERRED EMBODIMENT

With reference to the drawings there is shown a step ladder for use on an uneven surface. A top platform 11 serves to connect the two main portions of the step ladder namely a step frame 13 and a support frame 15. On the underneath surface of the top platform 11 a pair of struts 17 are located which are parallel to one another. Adjacent one edge of the top platform 11, the step frame 13 is pivotably mounted on the struts 17. Adjacent the other edge, the support frame 15 is also pivotably mounted on the struts 17.

The step frame 13 includes two step side members 19 which generally are located in an angular relationship such that as they extend away from the top platform 11, they separate further from one another. Horizontally across the step frame 13 are a plurality of steps 21, each one of which is substantially parallel to the others and to the top platform 11. The steps 21 are also generally spaced equidistant along the step frame 13.

The support frame 15 also includes two supoort side members 23 which are separated at the top but form a general V-shaped configuration with an apex 25 at the end opposite from the top platform 11. A solid V-shaped block 27 is rigidly mounted between the two support side members 23 of the support frame 15 at the apex 25. An adjustment bolt means 29 is rigidly secured centrally between the two support side members 23 of the support frame 15 and at the apex 25.

A leveling bar 31 is located at the apex 25. The leveling bar 31 has an arcuate shape with the ends of the leveling bar 31 extending below the apex 25 of the support frame 15. The leveling bar 31 is pivotably mounted on a leveling bolt means 32 located at the end of the apex 25. The leveling bolt means 32 pivotably engages the leveling bar 31 at the center point of the leveling bar 31.

An adjustment bar 33 is pivotably connected to the leveling bar 31 by means of a pin 34 located at one end of the adjustment bar 33 and midway between the leveling bolt means 32 and one end of the leveling bar 31.

The adjustment bar 33 extends upwardly generally in a forty-five degree angle when the step ladder is on level ground. An elongated slot 35 is located toward one end of the adjustment bar 33 and the adjustment bolt means 29 slidably engages the slot 35. A nut means 37, preferably a wing nut, threadably engages the adjustment bolt means 29 and when tightened down, holds the adjustment bar 33 in place. As best seen in FIG. 3, a raised platform 39 is rigidly mounted above and in a spaced relationship with the V-shaped block 27 where the adjustment bolt means 29 is rigidly mounted. While the V-shaped block 27 is mounted between the two support side members 23. The raised platform 39 is mounted on the outside of the two side support members 23 so as to permit the adjustment bar 33 to be substantially parallel with the support frame 15.

As can be readily seen, when the step ladder is placed on uneven ground the leveling bar 31 pivots to accommodate the uneven surface. To pivot the leveling bar 31, the adjustment bolt means 29 is released sufficiently to permit the adjustment bar 33 to slide. When the proper position of the leveling bar 31 is achieved with the step ladder in a proper upright position the nut means 37 is tightened down thereby holding the leveling bar 31 in place for use.

The operation and use of the invention hereinabove described will be evident to those skilled in the art to which it relates in consideration of the foregoing. It will thus be seen that there is provided a device from which the several objects of this invention are achieved and which is well adapted to meet the conditions of practical use. Its advantages are easily seen.

It is thought that persons skilled in the art to which this invention relates will be able to obtain a clear understanding of the invention after considering the foregoing description in connection with the accompanying drawings. Therefore, a more lengthy description is deemed unnecessary.

The invention may be embodied in other specific forms without departing from the spirit or essential characteristics thereof. The present embodiments are, therefore, to be considered in all aspects as illustrative and not restrictive. The scope of the invention is indicated by the appended claims rather than the foregoing description and all changes which come within the meaning of the range and equivalency of the claims are, therefore, intended to be embraced therein.

I claim:

1. A step ladder for use on an uneven surface, comprising:

a top platform including a generally rectangularly-shaped member with an underside surface;

a step frame including two step side members and a plurality of cross members located between the two side members and being rigidly affixed thereto, each cross member being located substantially parallel to one another and to the top platform, both side members being pivotably connected to the underside surface of said top platform;

a support frame including two support side members joined together at one end in a V-shaped configuration with an apex at one end and two separated members at the other end, the two separated members being pivotably mounted to the underside of said top platform, said support frame further including a V-shaped block rigidly mounted between the two support side members at the apex;

a leveling bar including an elongated member with an arcuate shape, said leveling bar being pivotably mounted at its center point on the apex of the support frame with the ends of the leveling bar extending beyond the apex;

a raised platform rigidly mounted on the outside of the two support members above the V-shaped block;

an adjustment bar including an elogated bar with a slot along its centerline located toward one end of the adjustment bar said adjustment bar being pivotably mounted at its other end on the leveling bar approximately midway between the one end of said leveling bar and the center point of the leveling bar;

a bolt means rigidly mounted in said raised platform and slidably mounted in the slot of the adjustment bar; and a nut means threadably engaging said bolt means for securing said adjustment bar in a fixed position.

2. A step ladder according to claim 1 wherein the adjustment bar is pivotably mounted on the leveling bar by a pin.

* * * * *